US012589286B2

(12) United States Patent
Chen et al.

(10) Patent No.: US 12,589,286 B2
(45) Date of Patent: Mar. 31, 2026

(54) EASY-TO-ASSEMBLE TRAMPOLINE WITH SPRAY ELEMENTS

(71) Applicant: BESTWAY INFLATABLES & MATERIAL CORP., Shanghai (CN)

(72) Inventors: Xiaobo Chen, Jinhua City (CN); Fengwang Chen, Jinhua City (CN); Yanping Wu, Jinhua City (CN); Deju Yu, Jinhua City (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 88 days.

(21) Appl. No.: 18/593,559

(22) Filed: Mar. 1, 2024

(65) Prior Publication Data

US 2024/0325852 A1 Oct. 3, 2024

(30) Foreign Application Priority Data

Mar. 27, 2023 (CN) ..... 202320663843.4

(51) Int. Cl.
*A63B 71/02* (2006.01)
*A63B 5/11* (2006.01)

(52) U.S. Cl.
CPC ..... *A63B 71/022* (2013.01); *A63B 5/11* (2013.01); *A63B 71/023* (2013.01)

(58) Field of Classification Search
CPC ..... A63B 5/11; A63B 71/023; A63B 71/022; A63B 71/0054; A63B 21/023;
(Continued)

(56) References Cited

U.S. PATENT DOCUMENTS 3,734,496 A * 5/1973 Rubin ..... A63B 5/11 182/139
3,779,201 A * 12/1973 Spahn ..... B63B 1/047 441/78

(Continued)

FOREIGN PATENT DOCUMENTS

DE 202018102426 5/2019

OTHER PUBLICATIONS

Extended European Search Report dated 17.09.2024 (Sep. 17, 2024). 7 pages, issued on related European Patent Application 24165754.3 by the European Patent Office.

*Primary Examiner* — Garrett K Atkinson
(74) *Attorney, Agent, or Firm* — Dickinson Wright PLLC

(57) ABSTRACT

There is presented an easy-to-assemble trampoline kit, providing improved assembly complexity and reducing assembly time over prior approaches, while also enhancing stability and user safety. Aspects of the present invention include: a support frame for mounting a rebounding mat and a protective net, net support posts for mounting and positioning the protective net; wherein lower ends of the net support posts are inserted into connection joints of the support frame, and the protective net is connected to the net support posts such that the protective net is in a tensioned state. Also provided with the trampoline are water spray nozzles to enhance user enjoyment of the trampoline. Such an easy-to-assemble trampoline allows for a convenient assembly operation of the net support posts on a trampoline, and a convenient connection between the protective net and the net support posts, which is conducive to efficient trampoline assembly and safety.

20 Claims, 9 Drawing Sheets

(58) Field of Classification Search
CPC ..... A63B 2210/58; A63B 2071/0072; A63B 2225/093; A63B 61/003; A63B 2208/12; A63B 2071/0063
See application file for complete search history.

(56) References Cited

U.S. PATENT DOCUMENTS

| | | | | | |
|---|---|---|---|---|---|
| 4,037,835 | A * | 7/1977 | Forsyth | A63B 5/11 | 248/346.5 |
| 5,385,518 | A * | 1/1995 | Turner | A63B 5/11 | 482/23 |
| 5,637,057 | A * | 6/1997 | Collura | A63B 5/11 | 482/77 |
| 5,810,695 | A * | 9/1998 | Sass | B63B 34/52 | 441/37 |
| 6,053,845 | A * | 4/2000 | Publicover | A63B 71/023 | 482/28 |
| 6,071,213 | A * | 6/2000 | Raasch | E04H 4/0056 | 482/29 |
| 6,261,207 | B1 * | 7/2001 | Publicover | A63B 71/023 | 482/28 |
| 6,447,426 | B2 * | 9/2002 | Peterson | A63B 5/11 | 441/40 |
| 6,508,682 | B1 * | 1/2003 | Clark | B63B 34/52 | 441/131 |
| 7,354,381 | B2 * | 4/2008 | Greiner | A63B 71/022 | 482/29 |
| 7,794,360 | B2 * | 9/2010 | Publicover | A63B 71/022 | 482/28 |
| 7,833,132 | B2 * | 11/2010 | Hylbert | B63B 34/52 | 482/28 |
| 8,790,221 | B2 * | 7/2014 | Schaffer | A63B 5/11 | 482/29 |
| 10,758,763 | B1 * | 9/2020 | Chen | A63G 9/00 | |
| 11,724,145 | B1 * | 8/2023 | Stamper | A63B 71/022 | 482/29 |
| 2002/0137598 | A1 * | 9/2002 | Publicover | A63B 5/11 | 482/27 |
| 2003/0064861 | A1 * | 4/2003 | Chen | A63B 5/11 | 482/27 |
| 2004/0107491 | A1 * | 6/2004 | Publicover | E04H 4/108 | 4/498 |
| 2004/0176214 | A1 * | 9/2004 | Yueh | A63B 5/11 | 482/27 |
| 2006/0194674 | A1 * | 8/2006 | Hickey | A63B 5/11 | 482/29 |
| 2009/0181827 | A1 * | 7/2009 | Hylbert | B63B 34/52 | 482/29 |
| 2009/0260148 | A1 * | 10/2009 | Chen | E04H 4/0025 | 4/506 |
| 2009/0264042 | A1 * | 10/2009 | Chen | A63G 31/12 | 446/221 |
| 2010/0035730 | A1 * | 2/2010 | Dukart | A63B 5/11 | 482/27 |
| 2010/0081549 | A1 * | 4/2010 | Thompson | A63B 21/4037 | 482/26 |
| 2010/0190608 | A1 * | 7/2010 | Publicover | A63B 5/11 | 482/29 |
| 2010/0229296 | A1 * | 9/2010 | Samuel | E04H 4/0025 | 4/506 |
| 2012/0289379 | A1 * | 11/2012 | Stokes | A63B 5/11 | 482/27 |
| 2014/0066260 | A1 * | 3/2014 | Liu | A63B 5/11 | 482/27 |
| 2016/0030794 | A1 * | 2/2016 | Yang | A63B 5/11 | 482/28 |
| 2016/0096055 | A1 * | 4/2016 | Smock | A63B 71/022 | 482/27 |
| 2016/0107016 | A1 * | 4/2016 | Haggerty | A63B 21/023 | 482/29 |
| 2017/0080270 | A1 * | 3/2017 | Andon | A63B 5/11 | |
| 2017/0216648 | A1 * | 8/2017 | Male | A63B 71/023 | |
| 2017/0340939 | A1 * | 11/2017 | Chen | A63B 67/10 | |
| 2018/0214728 | A1 * | 8/2018 | Ben Meir | E04H 4/0056 | |
| 2018/0280750 | A1 * | 10/2018 | Fischer | A63B 21/4035 | |
| 2018/0290000 | A1 * | 10/2018 | Chen | A63B 71/022 | |
| 2018/0369629 | A1 * | 12/2018 | Publicover | A63B 5/11 | |
| 2020/0222738 | A1 * | 7/2020 | Kuo | A63B 5/11 | |
| 2020/0238152 | A1 * | 7/2020 | Hagel | A63B 21/0428 | |
| 2021/0228967 | A1 * | 7/2021 | Mann | A63B 71/0054 | |
| 2024/0198159 | A1 * | 6/2024 | Chen | A63B 71/023 | |

* cited by examiner

A

D

E–E

EASY-TO-ASSEMBLE TRAMPOLINE WITH SPRAY ELEMENTS

CROSS-REFERENCE TO RELATED APPLICATIONS

This application claims the full benefit of and priority to Chinese Application Number CN202320663843.4 filed in China on Mar. 27, 2023, the disclosure of which is fully incorporated herein by reference for all purposes.

FIELD AND BACKGROUND OF THE INVENTION

Field of the Invention

The present disclosure relates to the technical field of trampolines, and in particular to an easy-to-assemble trampoline with a water spray feature.

Background of the Invention

At present, a common trampoline comprises tubular loop members, tubular legs, protective net support posts, a rebounding mat, a spring cover cushion, a protective net, and other components. Products are assembled on site after being transported to an installation location, in which lower ends of the protective net support posts of the trampoline are connected to the tubular loop members, and the protective net is connected to the protective net support posts. In prior trampolines, the protective net support posts are connected and fastened to the tubular loop members by means of screws or other fasteners, such as awkward U-bolts, and the protective net is connected to the protective net support posts through use of glass fiber rods, resulting in a cumbersome assembly operation requiring tool use to manipulate a number of fasteners that leads to more difficulty during assembly and a corresponding higher likelihood of assembly error.

SUMMARY OF THE INVENTION

The following summary of the invention is exemplary and explanatory only and is not necessarily restrictive of the invention as claimed. The summary is intended to present general aspects of the present invention in order to provide a basic understanding of at least some features of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Further, it should be noted that in various embodiments, description is made with reference to figures, in which like reference numerals refer to similar or identical items in the drawings. However, certain embodiments may be practiced without one or more of these specifically identified details, or in combination with other known methods and configurations. In the following summary and detailed description, numerous details are set forth, such as specific configurations, dimensions and processes, etc., in order to provide a thorough understanding of the present invention. In other instances, well-known processes and conventional hardware have not been described in particular detail in order to not unnecessarily obscure the present invention. Reference throughout this specification to "one embodiment," "an embodiment" or the like means that a particular feature, structure, configuration, or characteristic described in connection with the embodiment is included in at least one embodiment of the invention. Thus, the appearances of the phrase "in one embodiment," "an embodiment," or the like in various places throughout this specification are not necessarily referring to the same embodiment of the invention. Furthermore, the particular features, structures, configurations, or characteristics may be combined in any suitable manner in one or more embodiments.

In order to overcome the above defects, the present invention provides an easy-to-assemble trampoline kit, which allows for a convenient assembly operation of the net support posts on a trampoline, and a convenient connection between the protective net and the net support posts, which is conducive to expediting trampoline assembly. Embodiments of the present invention also provide for spray nozzles to direct water into an internal chamber defined by a protective net, a rebounding mat, and an awning.

In order to solve the above technical problems, one aspect of the present invention uses the following technical solution: an easy-to-assemble trampoline, comprising:

- a support frame for mounting a rebounding mat and a protective net; and
- net support posts for mounting and positioning the protective net; wherein
- lower ends of the net support posts are inserted into the support frame, and the protective net is connected to the net support posts such that the protective net is in a tensioned state.

When a net support post is required to be assembled on a trampoline, only the lower end of the net support post needs to be inserted into the support frame, which is convenient to operate. The protective net is directly connected to the net support posts such that the protective net is in a tensioned state through elastic net support bands respectively coupled to the net support posts, urging the net support posts and the protective net toward one another, and the protective net and the net support posts are connected without glass fiber rods, such that the connection of the protective net is more convenient, and the protective effect of the protective net is ensured.

Such an easy-to-assemble trampoline allows for a convenient assembly operation of the net support posts on a trampoline, and a convenient connection between the protective net and the net support posts, which is conducive to improving the working efficiency of trampoline assembly.

Preferably, a net support band is connected between each of the net support posts and the protective net.

The elastic connection is realized between the protective net and the net support posts by means of the elastic net support bands, and the tension of the protective net can be automatically adjusted. When a customer hits the protective net during use, the net support posts can bear forces at multiple points simultaneously, which has better cushioning performance and is safer and more reliable to use.

Preferably, each of the net support posts is provided with a net support connector, the net support connector is provided with a band retention cavity, and the net support band is engaged with the band retention cavity.

The net support band is engaged with the band retention cavity in the net support connector, which is convenient for connection.

Preferably, an awning is mounted above the support frame, a plurality of awning retention bands are connected to the awning, and the awning retention bands are engaged with the band retention cavities.

The awning is engaged with the band retention cavities via the awning retention bands, which is convenient and reliable for assembly.

Preferably, the band retention cavity is in an L-shaped structure. The net support band and the awning retention band are engaged with the L-shaped band retention cavity, which is less prone to detachment.

Preferably, a water spray head is provided on the net support connector and is provided with an articulating spray nozzle for spraying water towards the protective net.

Water is sprayed towards the trampoline through an articulating spray nozzle in the water spray head, which plays a cooling role and enhances enjoyment while the trampoline is in use.

Preferably, a water supply pipe is connected between two adjacent water spray heads, all of the water supply pipes are connected into a circle, and the articulating spray nozzle is in communication with the water supply pipe.

The water spray heads are connected to each other by means of the water supply pipes, and a water spray action can be realized by introducing water flow into the water supply pipe at any position, which is very convenient. Moreover, all of the water supply pipes are connected into a circle, which is conducive to improving the stability of the overall structure of the net support posts.

Preferably, the support frame is provided with structural connection joints corresponding to the net support posts, each of the structural connection joints is provided with a net support post receiver, and the lower end of the net support post is inserted into the net support post receiver.

The lower end of the net support post is directly inserted into the net support post receiver in a structural connection joint, which is convenient for assembly.

Preferably, the support frame comprises arcuate tubular loop members and tubular legs, the tubular loop members are connected to each other to form a circle, the structural connection joint is provided with a transverse loop member receiver and a leg receiver, connection positions of the two adjacent tubular loop members are inserted into the transverse loop member receiver, and an upper end of the tubular leg is inserted into the leg receiver.

The structural connection joint is connected to the tubular loop member by means of the transverse loop member receiver, which is convenient for assembly. An upper end of the tubular leg is inserted into the leg receiver, which is convenient for assembly. The tubular loop member, the tubular leg, and the net support post are assembled together by means of the structural connection joint, which is convenient for assembly and is reliable for connection.

Preferably, a lower end of the protective net is sewn on the rebounding mat.

The protective net and the rebounding mat are integrally sewn, which makes it unnecessary for users to assemble, reducing the installation time of the users and avoiding a gap between the protective net and the rebounding mat, eliminating risks of pinching the users.

Another embodiment of the present invention provides a trampoline kit. The kit provides components that are designed to ease assembly, decrease assembly time, provide for additional features over prior trampolines, and improve safety over prior approaches. In one embodiment, a trampoline kit comprises a support frame for mounting a rebounding mat and a protective net, the support frame including a plurality of arcuate tubular loop members and a plurality of structural connection joints configured to be respectively connected between each of the plurality of tubular loop members. The kit further includes a plurality of net support posts for mounting and positioning the protective net, each of said plurality of net support posts having a terminal end and a connector end, wherein respective terminal ends of the net support posts are configured to be respectively inserted into and retained within the plurality of structural connection joints; and the protective net is configured to be connected to respective connection ends of the plurality of net support posts such that the protective net is in a tensioned state.

The protective net of the trampoline kit may include a plurality of net support bands attached thereto, wherein the net support bands are configured to be respectively connected to couple each of the plurality net support posts with the protective net. In one embodiment, each of the net support posts includes a net support connector, the net support connector including a band retention cavity configured to accept and retain at least one of the net support bands within the band retention cavity. Further, in an embodiment, the band retention cavity may comprise an L-shaped opening defined within the net support connector, or may comprise any concave-shaped cavity such as a v-shaped cavity or an arcuate-shaped cavity.

The trampoline kit may further comprise an awning that is configured to be mounted above an assembled support frame, wherein a plurality of awning retention bands attached to the awning are configured to be respectively coupled to the plurality of net support connectors through insertion into and retention by the band retention cavities within each of the respective net support connectors. In an additional aspect, the band retention cavity may be configured to accept at least one of the awning retention bands and at least one of the net support bands together in the band retention cavity. The awning retention bands and net support bands, in various embodiments, may be elastically deformable and/or stretchable.

The trampoline kit may provide for a water spray feature. In one embodiment, the net support connector includes a spray head having an articulating spray nozzle for spraying water towards the protective net. Further, the spray head may comprise a transverse fluid channel in fluid communication with the articulating spray nozzle, and the transverse fluid channel may be configured to be connected in fluid communication between two adjacent water spray heads deployed on adjacent net support connectors. Additionally, in various embodiments, the articulating spray nozzle may be configured to be rotatively translated from a first position to a second position thereof, thereby adjusting direction of water output from the articulated spray nozzle.

In an embodiment of the trampoline kit of the present invention, each of the structural connection joints includes a net support post receiver, and the net support post receiver is configured to retain the respective net support post through one or more of a spring button or a fastener. In an additional embodiment, the trampoline kit may further comprise a plurality of tubular legs, each having an upper end configured to be respectively inserted within an opening in a leg receiver defined within each of the structural connection joints; and the leg receiver is configured to retain one of the plurality of tubular legs through one or more of a spring button or a fastener.

In yet another embodiment, the trampoline kit may have a lower end of the protective net sewn onto the rebounding mat. The trampoline kit may further comprise a plurality of springs configured to elastically couple the rebounding mat to the support frame.

In a further embodiment of the trampoline kit, each of the net support posts comprises an angular bend, allowing horizontal displacement of a vertical portion of the respective net support post in an outward direction from the protective net when each respective net support post is installed within respective structural connection joints.

There is also provided an embodiment of a trampoline that comprises a support frame for mounting a rebounding mat and a protective net, the support frame including a plurality of tubular loop members connected to intervening structural connection joints, the connected tubular loop members forming a circular shape; a plurality of tubular legs, with pair-wise interconnection to a respective plurality of leg support bases; and a plurality of net support posts for attaching and positioning the protective net, wherein: lower ends of the net support posts are inserted into the structural connection joints of the support frame, and the protective net is attached through a plurality of attached elastic net support bands, elastically engaged within a respective plurality of net support connectors of the plurality of net support posts, wherein the net support connectors are respectively disposed at a distal ends of the net support posts opposite the lower ends, such that the protective net is deployed in a tensioned state.

In an alternate embodiment, each of the net support connectors is provided with a band retention cavity, and the net support band is engaged with the band retention cavity. Further, as mentioned previously, the band retention cavity may comprise an L-shaped structure, and in another embodiment, an awning may be mounted above the support frame, a plurality of awning retention bands are connected to the awning, and the awning retention bands are engaged with the respective band retention cavities. In yet another embodiment, the trampoline, in various embodiments, may include a plurality of water spray head respectively disposed on the net support connectors, the spray heads including articulating spray nozzles for spraying water towards the protective net.

Compared with the prior art, the present invention has the beneficial effects that (1) such a trampoline and/or trampoline kit allows for a convenient assembly operation of the net support posts on a trampoline, and a convenient connection between the protective net and the net support posts, which is conducive to improving the working efficiency of trampoline assembly; (2) the elastic connection is realized between the protective net and the net support posts by means of the net support bands, and the tension of the protective net can be automatically adjusted; when a customer hits the protective net during use, the net support posts can bear forces at multiple points simultaneously, which has better cushioning performance and is safer and more reliable to use; (3) the installation and fixation of the protective net, the awning and the water spray head are realized by means of the net support connector, which realizes the connection and combination of a plurality of accessories, facilitating rapid assembly of the trampoline; and (4) the protective net and the rebounding mat are integrally sewn, which makes it unnecessary for users to assemble, reducing installation time and avoids a gap between the protective net and the rebounding mat, eliminating risks of pinching the users.

BRIEF DESCRIPTION OF THE DRAWINGS

A more complete understanding of the present invention may be derived by referring to the detailed description and claims when considered in connection with the following illustrative figures.

DETAILED DESCRIPTION

Figure 1:
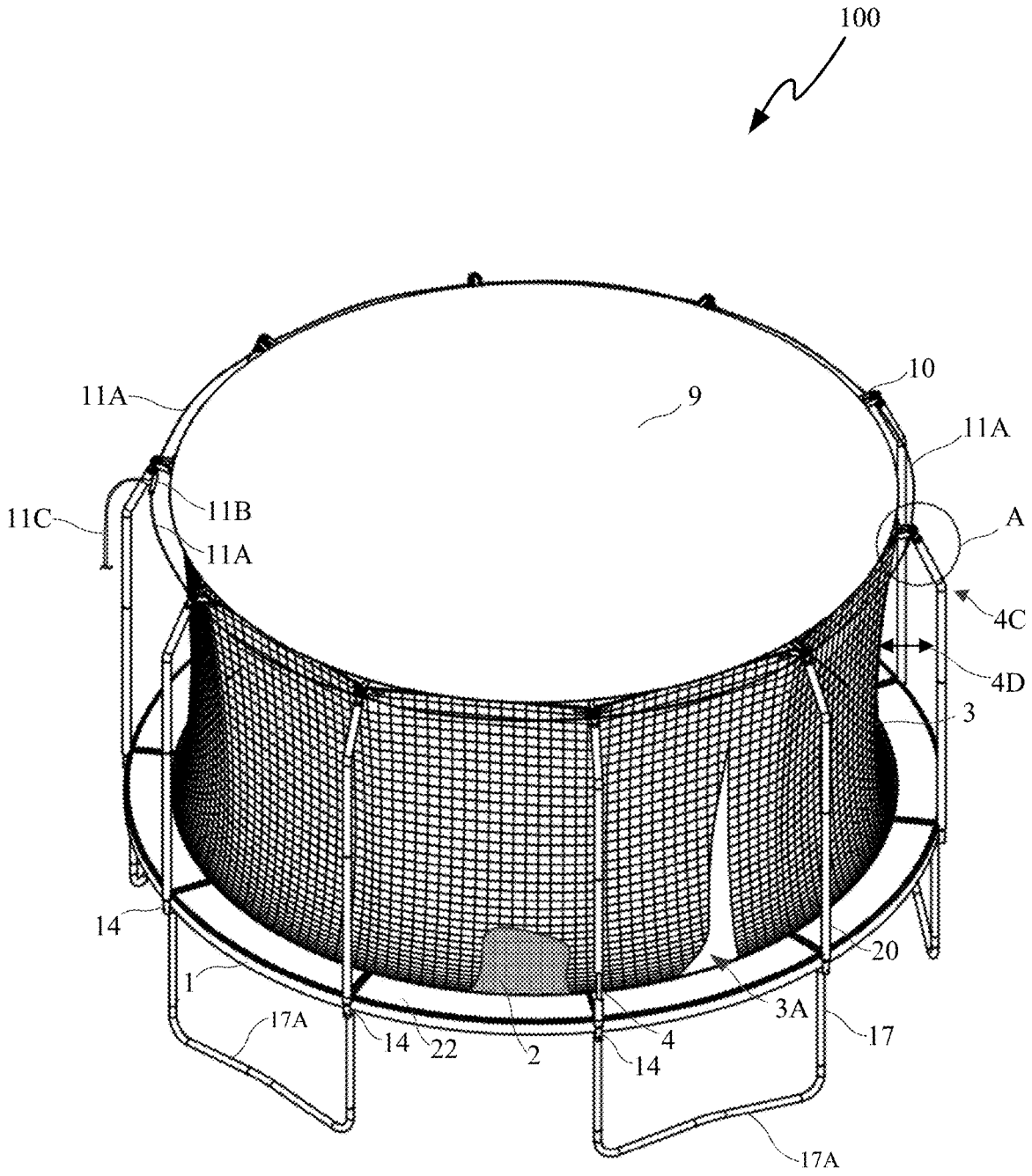
FIG. 1 shows a perspective view of an assembled trampoline of the present invention.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

The technical solutions of the present invention are further described in detail below by means of a particular embodiment and in conjunction with the accompanying drawings.

FIG. 1 illustrates an embodiment of an assembled trampoline 100 according to the present invention, utilizing components installed from a trampoline kit of the present invention (see FIGS. 2 to 8). The assembled trampoline comprises a support frame 1 for mounting a rebounding mat 2 and a protective net 3 (a partial view of the rebounding mat 2 is shown via partial cutaway of the protective net 3). The support frame 1 as assembled provides a circular structure for attaching the rebounding mat 2 through a plurality of interconnecting springs which are in turn covered by a spring cover cushion 22 (springs not shown for simplicity of illustration in FIG. 1). The support frame 1 as assembled also provides for attachment of net support posts 4 (an exposed section of one post 4 is shown without sheathing in FIG. 1) for mounting and positioning the protective net 3; wherein lower terminal ends of the net support posts 4 are inserted into structural connection joints 14 that are interconnected into the support frame 1, and the protective net 3 is connected to the net support posts 4 at connector ends (shown proximate letter "A" on FIG. 1) such that the protective net 3 is deployed in a tensioned state. Net support posts 4 include angular bends 4C that provide for a horizontal displacement 4D between the protective net 3 and the net support post 4, enhancing user safety and preventing inadvertent collisions between trampoline users and net support posts 4. A net opening 3A is shown within the protective net 3, providing a convenient ingress/egress point for users to access the trampoline. An awning 9 is also shown mounted above the support frame 1 proximate a top end of the protective net 3, and a trampoline play enclosure volume is thus defined by the awning 9, rebounding mat 2, and protective net 3.

Figure 2:
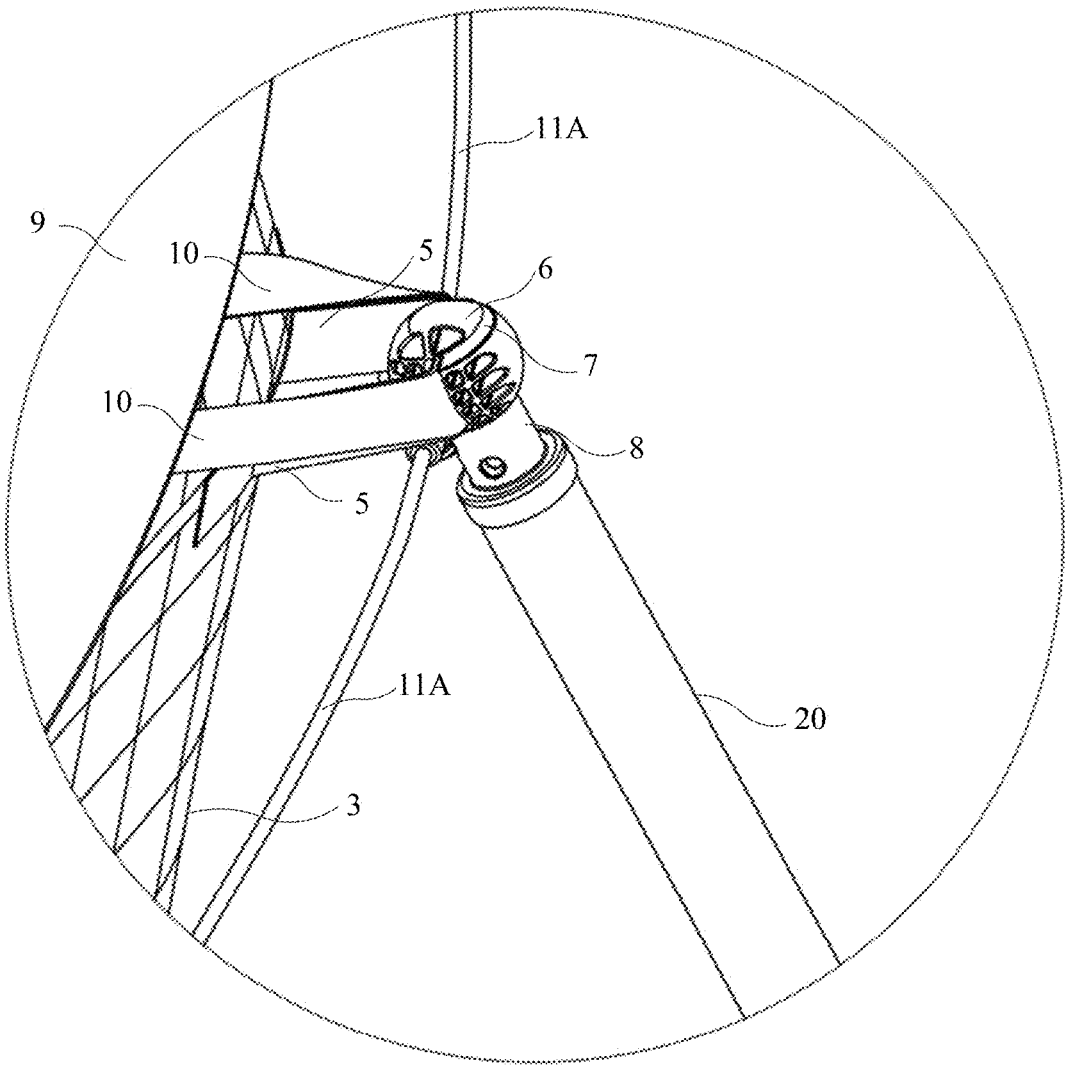
FIG. 2 is an enlarged partial view of part A in FIG. 1 of the present invention.

FIG. 2 shows an enlarged partial view of part "A" in FIG. 1, according to the present invention, and further illustrates connector ends of the net support posts 4 (the net support posts 4 are disposed inside of net support post sheath 20 as shown in FIG. 2). In an embodiment, the net support post sheath 20 is sheathed on an outer wall of the net support post 4, and in an additional embodiment, is made of foam to provide protection from rust and the elements, as well as providing cushioning from impacts from users of the trampoline 100.

Figure 2A:
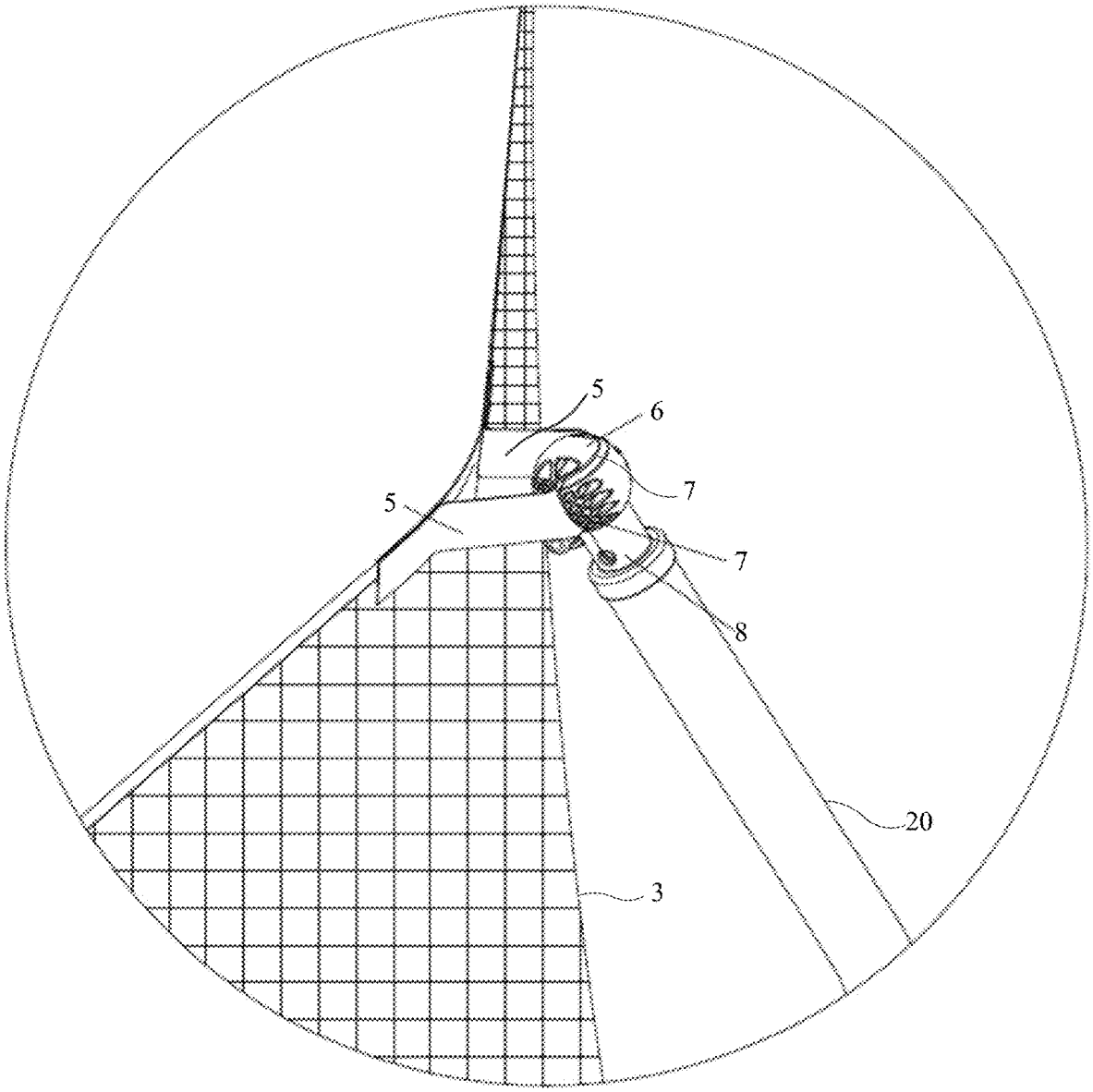
FIG. 2A is an additional simplified view of FIG. 2, with elements removed for clarity.

A connector end of net support post 4 is coupled to a connector 6. As also illustrated in simplified FIG. 2A, where components have been removed from FIG. 2 to show partially obscured elements, an elastic net support band 5 is connected between each of the net support posts 4 and the protective net 3. The net support band 5 is connected to an upper edge of the protective net 3 and is provided with a loop of elastic material that provides tension to urge the protective net 3 in an outward direction while also providing additional deformation capability of the protective net 3 to protect trampoline users who impact the protective net 3 during use. Each of the net support posts 4 is provided with a net support connector 6. The net support connector 6 is provided with a band retention cavity 7 which is of an L-shaped structure, and the loop of the net support band 5 is engaged with the band retention cavity 7 (FIG. 4 also shows the L-shaped band retention cavity 7 in more detail). The net support connector 6 is provided with a post connector sleeve 8 which is sleeved on an upper end of the net support post 4 and is fixed by means of a spring button clip or a fastener. The awning 9 is mounted above the support frame 1, and a plurality of awning retention bands 10 are connected to the awning 9. The awning retention bands 10 are engaged with the band retention cavity 7 and retained along with the net support bands 5.

Figure 3:
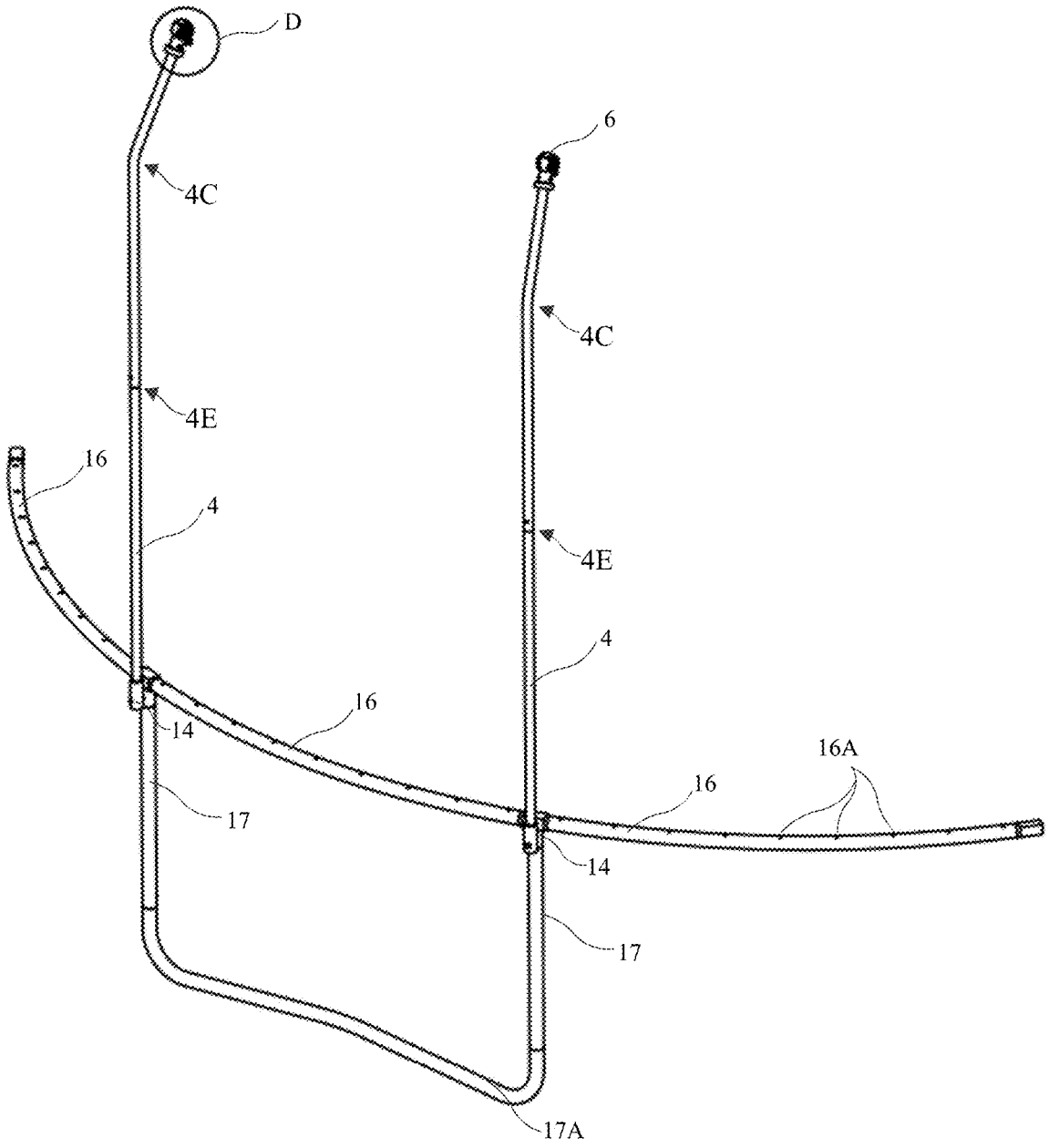
FIG. 3 is a schematic diagram of a structure showing the connection of an structural connection joint according to the present invention.

FIG. 3 illustrates a partial view of structural elements of the trampoline 100, where a plurality of tubular loop members 16 are connected to each other through the structural connection joints 14 to form the structural circular shape for support frame 1. Each of the tubular loop members 16 includes a plurality of loop member spring connection ports 16A for connecting a plurality of springs between the assembled loop members 16 and v-rings attached to the rebounding mat 2. The structural connection joints 14 are also connected to top portions of tubular legs 17, and bottom portions of two tubular legs 17 couple into a U-shaped leg support base 17A to provide horizontal stability of the tubular legs 17 and to provide additional surface area to reduce sinking of the tubular legs 17 into a compliant substrate underneath the trampoline 100. For ease of transport, the net support posts 4 may be provided in two sections (respective top and bottom sections) that are joined at point 4E during assembly of the trampoline. As shown in FIG. 3, the top sections of net support posts 4 are provided with angular bends 4C to enhance a horizontal displacement between the protective net 3 and the net support post 4, and are also provided at their respective connector ends with connectors 6, described above in regards to FIGS. 2, 2A and in enlarged section D shown in FIG. 4, discussed further below.

Figure 4:
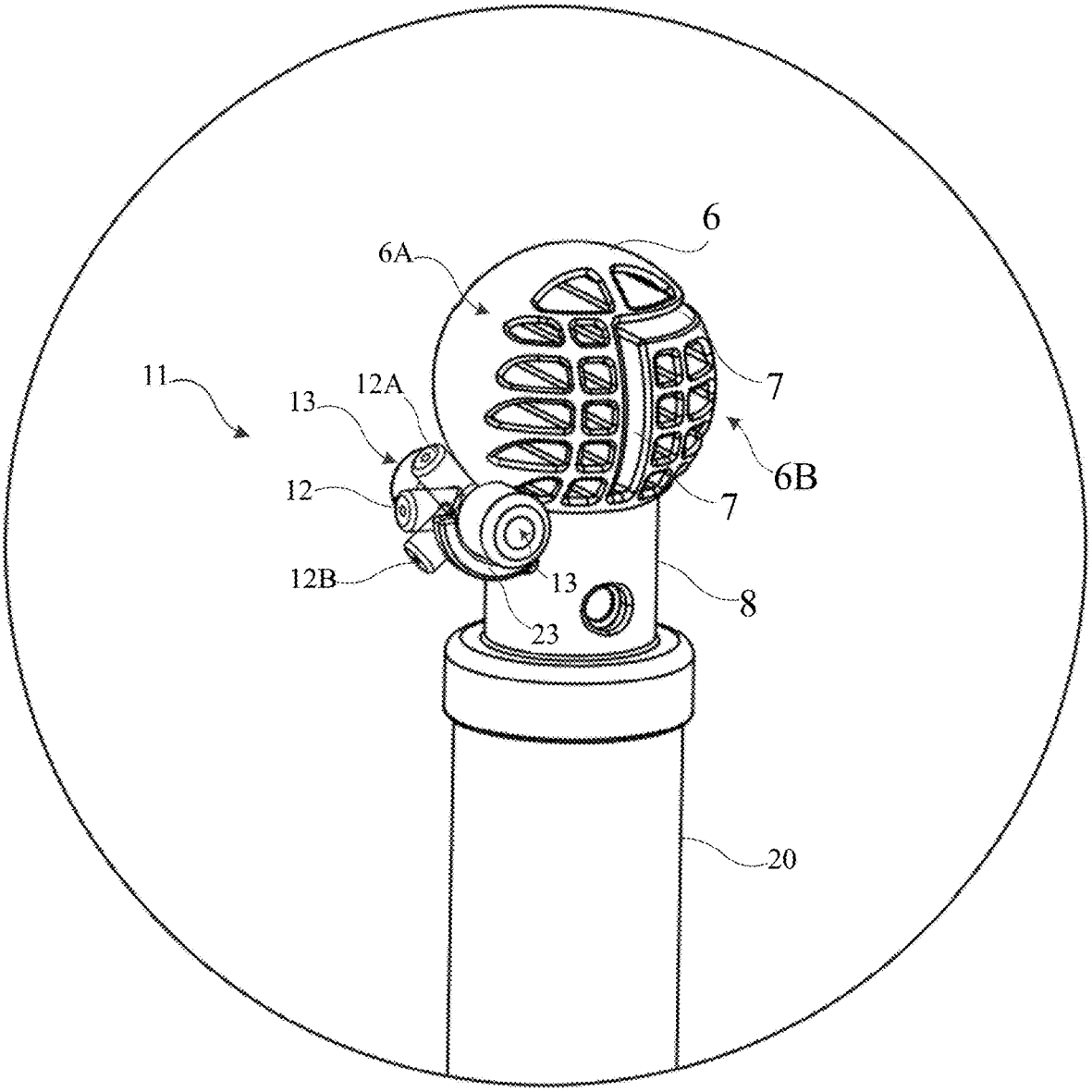
FIG. 4 is an enlarged partial view of part D in FIG. 3 of the present invention.

FIG. 4 provides an enlarged partial view of part D in FIG. 3 of the present invention, also more clearly showing elements of the connector 6 and the water spray head 11. The water spray head 11 is coupled to the net support connector 6 and includes an articulating spray nozzle 12 for spraying water towards the protective net 3. The water spray head 11 comprises a T-shaped structure, each of three ends of the T-shaped water spray head 11 is provided with a through-hole, and the three through-holes are in fluid communication with one another, one through-hole being formed as the articulating spray nozzle 12, and the other two through-holes being formed as transverse fluid channels 13. The net support connector 6 is provided with nozzle clamping lugs 23 corresponding to the water spray head 11. A clamping recess is formed between the nozzle clamping lugs 23 and the net support connector 6, and the angle of the water spray head 11 can be freely adjusted up and down when the water spray head 11 is clamped and retained within the clamping recess (three alternative exemplary positions of the spray nozzle 12 are shown-one essentially horizontal position 12, one upward position 12A, and one downward position 12B). Two nozzle clamping lugs 23 are provided (one lug 23 shown in the foreground, and a second lug obscured behind the spray nozzle), and the spray nozzle 12 end of the T-shaped water spray head 11 extends out between the two nozzle clamping lugs 23.

As shown in FIGS. 1 and 2, and in further view of FIG. 4, a water supply pipe 11A is connected between two adjacent water spray heads 11 that are deployed on adjacent net support connectors 6, the transverse fluid channel 13 at either end of the water spray head 11 being connected to the water supply pipe 11A. All of the water supply pipes 11A of the trampoline 100 are connected into a circle, and each respective articulating spray nozzle 12 of the plurality of spray heads 11 is in communication with the water supply pipe 11A. A water intake tee 11B (shown in FIG. 1) is mounted between any one of the transverse fluid channels 13 and the water supply pipe 11A. A water intake pipe 11C is connected to the water intake tee 11B, and water is supplied to the water spray head 11 through the water intake pipe 11C, such that a water spray operation is realized. In one embodiment, the water intake pipe 11C may be connected to the male end of a garden hose through a female garden-hose connector, allowing straightforward water supply connection in either a residential or commercial setting.

As mentioned above, the net support connector 6 as shown in FIG. 4 includes a band retention cavity 7 which is comprises an L-shaped structure, and is configured to accept and retain a loop portion of the net support band 5 and the awning retention band 10. The band retention cavity 7 may substantially divide the net support connector 6 into a net-side upper portion 6A and a lower exterior portion 6B. The net side portion 6A substantially forms a hook shape, and the exterior portion 6B defines a complementary confining portion, both portions being configured to retain one or more bands disposed within the L-shaped opening of the band retention cavity 7, even when the bands are subjected to dynamic deformation forces arising from active use of the trampoline. While an L-shaped structure of the band retention cavity 7 is shown and described, those of skill in the art recognize that an arcuate-shaped, V-shaped, or other concave-shaped cavity may be utilized within the net support connector 6 to achieve similar results.

Figure 5:
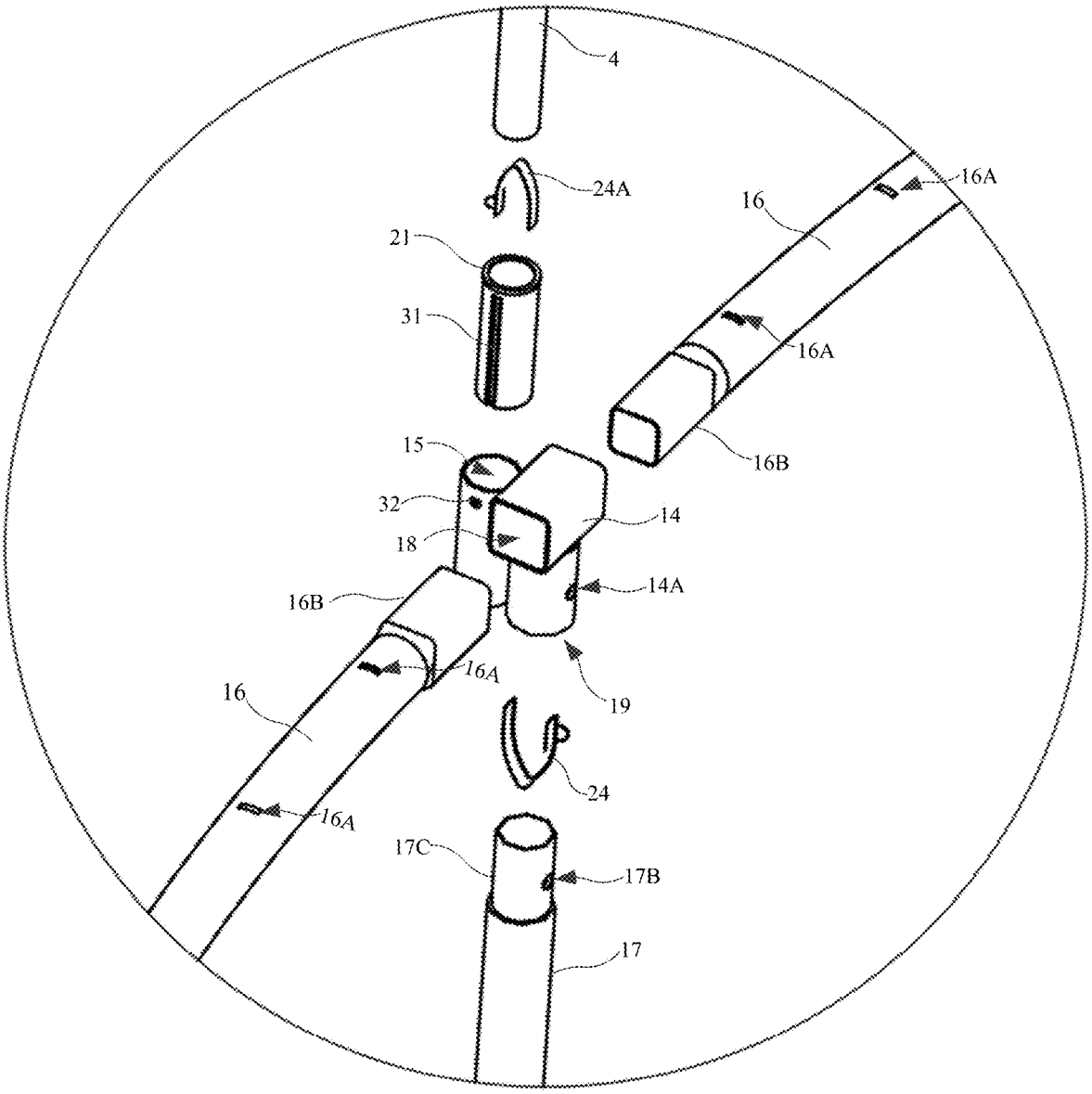
FIG. 5 is a schematic diagram of a structure showing the fixation of a net support post with a spring button clip according to the present invention.
Figure 6:
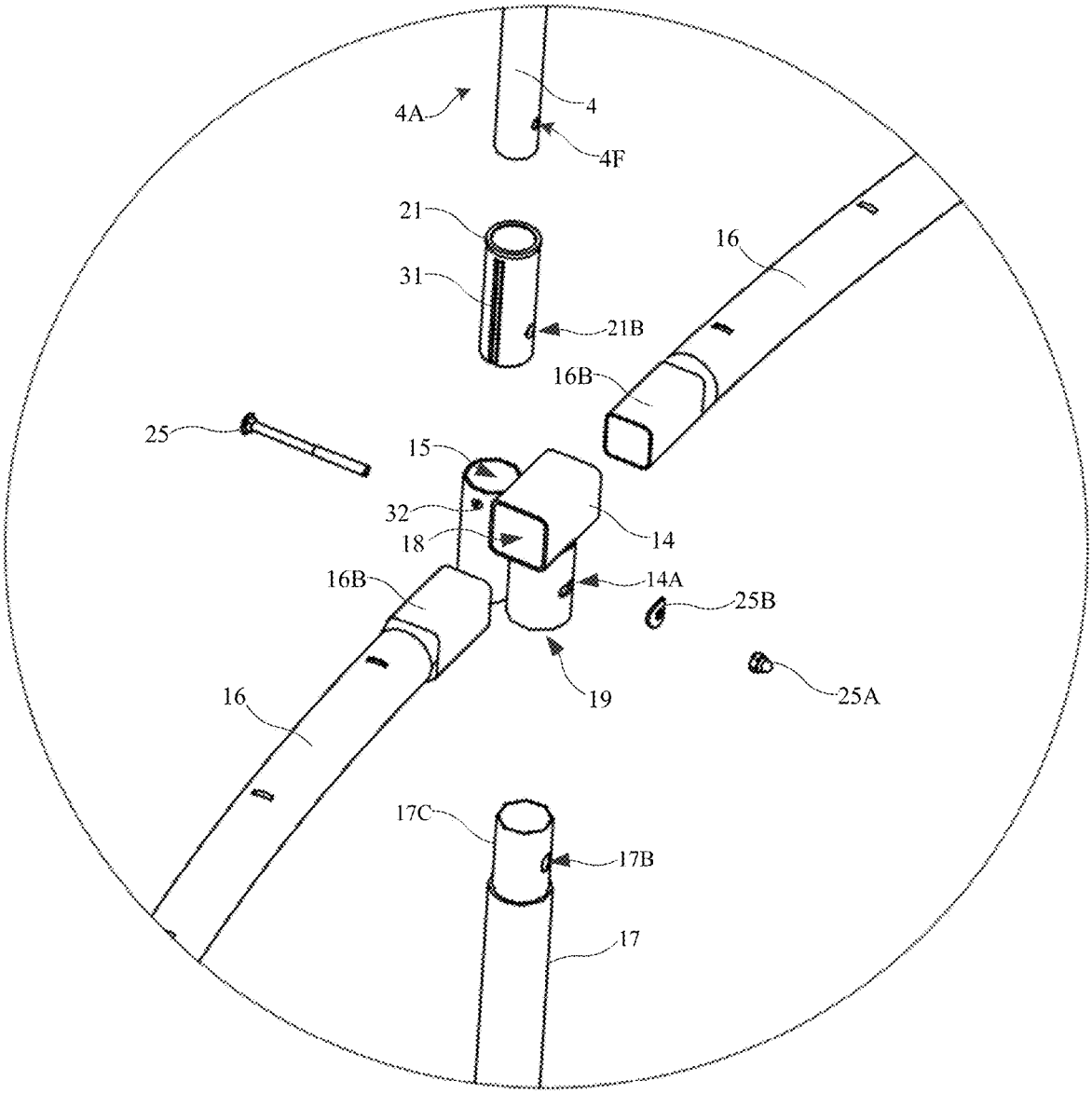
FIG. 6 is a schematic diagram of a structure showing the fixation of a net support post with a fastener according to the present invention.

FIGS. 5 and 6 provide exploded diagrams showing components of the present invention in the context of interconnecting to the structural connection joint 14. FIG. 5 illustrates attachment of a net support post 4 and tubular leg 17 with spring button clips 24, and FIG. 6 shows attachment of a net support post 4 and tubular leg 17 with a fastener 25 in accordance with the present invention. The structural connection joint 14 is provided with transverse loop member receiver 18 defined within a horizontal channel of the structural connection joint 14, and a substantially vertical leg receiver 19 and a net support post receiver 15. Two adjacent tubular loop members 16 are shown, each having a loop member terminal end 16B that is configured to be respectively inserted into the transverse loop member receiver 18. As mentioned above, the support frame 1 comprises a plurality of tubular loop members 16 and tubular legs 17, where the tubular loop members 16 are connected to each other through the transverse loop member receiver 18 of structural connection joints 14 to form a circle. Each pair of adjacent tubular loop members 16 are configured to be inserted into the transverse loop member receiver 18, and an upper end of the tubular leg 17 forms a tubular leg upper connecting portion 17C that is configured to be inserted into the leg receiver 19. Thus, to affect assembly, the support frame 1 is formed with structural connection joints 14 affixing the net support posts 4 and legs 17, each of the structural connection joints 14 receives two tubular loop members 16 at opposite sides through respective loop member terminal ends 16B, and the legs 17 and net support posts 4 are affixed to the structural connection joints 14. Bottom portions of two tubular legs 17 couple into a U-shaped leg support base 17A, and two upper ends of the tubular legs 17 are respectively inserted into the leg receiver 19 of the two adjacent structural connection joints 14.

The structural connection joint 14 further includes a net support post receiver 15, wherein a bottom end 4A of a net support post 4 is configured to be inserted within the net support post receiver 15 with an intervening anti-rust insert sleeve 21. More particularly, an anti-rust insert sleeve 21 is configured to be inserted between an inner wall of the net support post receiver 15 and the outer wall of the net support post 4. A guide slot 31 is provided in a side wall of the anti-rust insert sleeve 21, while a raised anti-rotation protrusion 32 is provided on the inner wall of the net support post receiver 15, so that the anti-rust insert sleeve 21 is inserted into the net support post receiver 15 as the guide slot 31 is aligned with the anti-rotation protrusion 32, thereby realizing the guidance and positioning of the anti-rust insert sleeve 21. In an alternative embodiment, two (or more) protrusions may be defined within the inner wall of the net support post receiver 15, corresponding to two (or more) guide slots 31 to further enhance the anti-rotation feature of the anti-rust insert sleeve 21.

In FIG. 5, the tubular leg 17 is affixed to the structural connection joint 14 through a spring button clip 24 deployed within the tubular leg 17 and whose button is urged by the spring force of the spring button clip 24 to pass through both the leg spring button orifice 17B and the connecting joint affixing through-hole 14A when the tubular leg 17 is inserted within the structural connection joint 14 so as to align the openings 14A and 17B with respect to one another. Further, the net support post 4 is affixed and secured within the net support post receiver 15 of the structural connection joint 14 through a spring button clip 24A deployed within the net support post 4 and whose button is urged by the spring force of the spring button clip 24 to pass through a net support post orifice (not shown, behind item 4 in FIG. 5), a corresponding opening in the anti-rust insert sleeve 21 (not shown) and a corresponding opening in the net support post receiver 15 when the net support post 4 and anti-rust insert sleeve 21 are inserted within the structural connection joint 14 so as to align the aforementioned openings with respect to one another.

In FIG. 6 one fastener 25 such as the illustrated carriage bolt is passed through a series of aligned through-holes (14A, 17B, 21B, and 4F) within the structural connection joint 14 to affix the net support post 4, the structural connection joint 14 and the tubular leg 17 together. The fastener 25 may be secured within the aligned through-holes through use of any desired hardware such as a washer, lock washer, cylinder-conforming washer 25B, nut, lock nut, or acorn nut 25A as shown in FIG. 6.

Figure 7:
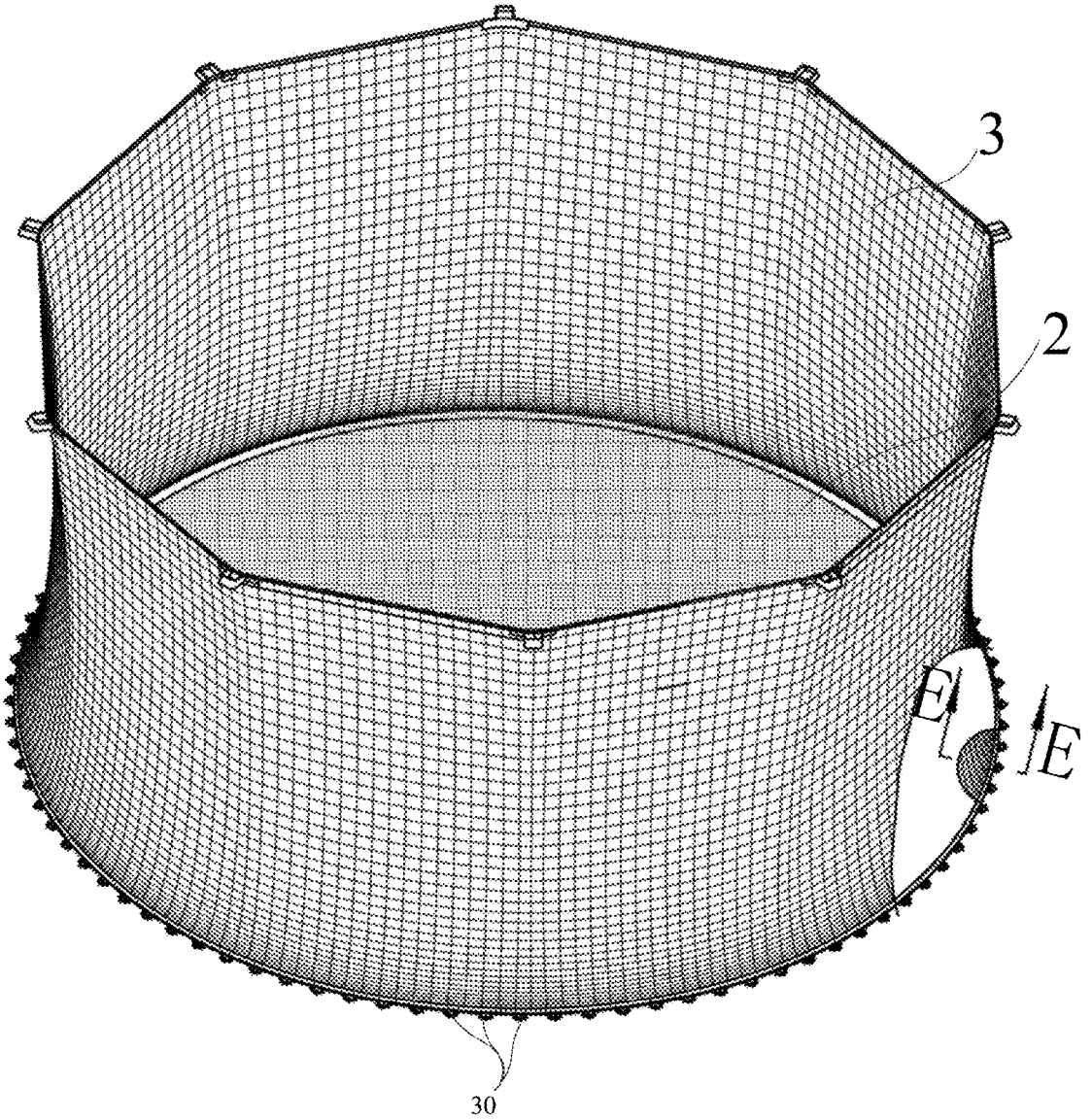
FIG. 7 is a schematic diagram of a structure showing the connection of a protective net and a rebounding mat according to the present invention.
Figure 8:
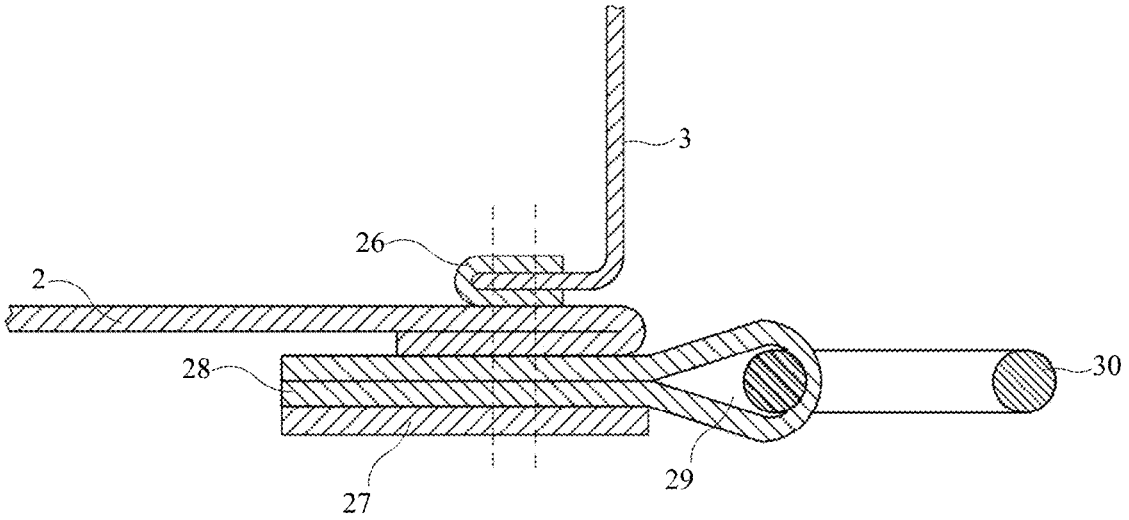
FIG. 8 is a cross-sectional view taken along line E-E in FIG. 7 of the present invention.

Referring to FIGS. 7-8, in FIG. 7, a perspective view of a schematic representation of an aspect of the present invention is provided, showing the connection of a protective net 3 and a rebounding mat 2 according to the present invention, and FIG. 8 illustrates a cross-sectional view taken along line E-E from FIG. 7.

An exemplary composition of the illustrated embodiments is as follows: a lower end of the protective net 3 is sewn onto the rebounding mat 2, and a spring cover cushion 22 is connected between an edge of the rebounding mat 2 and the tubular loop member 16. A net seam webbing 26 is sewed at a lower edge of the protective net 3. A lower webbing 27 and a mat retention webbing 28 are sewed at the edge of the rebounding mat 2. The mat retention webbing 28 is folded in half to form a v-ring retention loop 29, the v-ring retention loop 29 being connected to a v-ring 30, presenting a configuration where a spring (not shown) may be connected between the v-ring 30 and the tubular loop member 16. A plurality of v-rings 30 are shown disposed around the circumference of the rebounding mat 2 in FIG. 7, of which 3 are identified for example. The net seam webbing 26, the rebounding mat 2, the mat retention webbing 28 and the lower webbing 27 are sequentially stacked and then sewn together.

One embodiment of the present invention provides a kit of components identified above that, when assembled, form the trampoline 100 as shown and described herein. Any logical order of assembly may be undertaken within the spirit of the present invention to assemble the trampoline 100, and steps may be reordered where necessary for convenience of assembly. Embodiments of the trampoline kit of the present invention presents certain advantages. For example, when the net support post 4 is required to be assembled on a trampoline, only the lower end of the net support post 4 needs to be inserted into the support frame 1, which provides an efficient method of rapid assembly. Further, the protective net 3 may be directly connected to the net support posts 4 such that the protective net 3 is in a tensioned state, and the protective net 3 and the net support posts 4 may be connected without the use of glass fiber rods. Thus, attachment of the protective net 3 to the net support posts 4 is quicker and more effective than prior methods, and the protective effect of the protective net 3 is ensured. The elastic connection is further provided between the protective net 3 and the net support posts 4 through the elastic net support bands 5, and the tension of the protective net 3 can be automatically adjusted through elastic deformation of the net support bands 5. Further, when a user impacts the protective net 3 during use, the net support posts 4 can bear forces at multiple points simultaneously, which provides better cushioning performance and is safer and more reliable to use. The installation and fixation of the protective net 3, the awning 9 and the water spray heads 11 are realized through the net support connector 6, effectively combining the connection and combination of a plurality of accessories that prior trampoline designs required, facilitating rapid and effective assembly of the trampoline. Further, as the protective net 3 and the rebounding mat 2 are integrally sewn, unlike prior approaches, users do not need to attach the protective net 3 to the rebounding mat 2, reducing the installation time of the users, and avoiding a gap between the protective net 3 and the rebounding mat 2, eliminating risks of pinching the users.

The above-mentioned embodiments are only a preferred solution of the present invention which should not be construed as limiting in any way, and there are other variants and modifications as long as not beyond the scope of the technical solutions defined in the claims.

The particular implementations shown and described above are illustrative of the invention and its best mode and are not intended to otherwise limit the scope of the present invention in any way. Indeed, for the sake of brevity, some functional aspects of the systems may not be described in detail. Methods illustrated in the various figures may include more, fewer, or other steps. Additionally, steps may be performed in any suitable order without departing from the scope of the invention. Furthermore, the connecting lines shown in the various figures are intended to represent exemplary functional relationships and/or physical couplings between the various elements. Many alternative or additional functional relationships or physical connections may be present in a practical system.

Changes and modifications may be made to the disclosed embodiments without departing from the scope of the present invention. These and other changes or modifications are intended to be included within the scope of the present invention, as expressed in the following claims.

What is claimed is:

1. A trampoline kit, comprising:

a support frame including:

a plurality of arcuate tubular loop members; and a plurality of structural connection joints configured to be respectively connected between two adjacent ones of the plurality of arcuate tubular loop members; and a plurality of tubular legs configured to be respectively connected to a respective one of the plurality of structural connection joints;

a plurality of net support posts each having:

a terminal end configured to be respectively connected to a respective one of the plurality of structural connection joints; and a connection end opposite the terminal end;

a rebounding mat configured to be disposed on the support frame; and a protective net having:

an upper edge configured to be connected to the connection ends of the plurality of net support posts; and a lower edge sewn onto the rebounding mat.

2. The trampoline kit according to claim 1, wherein the protective net is configured to be connected to respective connection ends of the plurality of net support posts such that the protective net it in a tensioned state, wherein the protective net includes a plurality of net support bands attached thereto, wherein the net support bands are configured to be respectively connected to couple each of the plurality net support posts with the protective net.

3. The trampoline kit according to claim 2, wherein each of the net support posts includes a net support connector, the net support connector including a band retention cavity configured to accept and retain at least one of the net support bands within the band retention cavity.

4. The trampoline kit according to claim 3, further comprising an awning that is configured to be mounted above an assembled support frame, wherein a plurality of awning retention bands attached to the awning are configured to be respectively coupled to the plurality of net support connectors through insertion into and retention by the band retention cavities within each of the respective net support connectors.

5. The trampoline kit according to claim 4, wherein the band retention cavity is configured to accept at least one of the awning retention bands and at least one of the net support bands together in the band retention cavity.

6. The trampoline kit according to claim 4, wherein the awning retention bands and the net support bands are elastically deformable.

7. The trampoline kit according to claim 3, wherein the band retention cavity comprises an L-shaped opening defined within the net support connector.

8. The trampoline kit according to claim 3, wherein the net support connector includes a spray head having an articulating spray nozzle for spraying water towards the protective net.

9. The trampoline kit according to claim 8, wherein the articulating spray nozzle is configured to be rotatively translated from a first position to a second position thereof, thereby adjusting direction of water output from the articulated spray nozzle.

10. The trampoline kit according to claim 8, wherein:

the spray head further comprises a transverse fluid channel in fluid communication with the articulating spray nozzle; and the transverse fluid channel is configured to be connected in fluid communication between two adjacent water spray heads deployed on adjacent net support connectors.

11. The trampoline kit according to claim 8, wherein each tubular leg has an upper end configured to be respectively inserted within an opening of a leg receiver defined within each of the structural connection joints; and wherein the leg receiver is configured to retain one of the plurality of tubular legs through one or more of a spring button or a fastener.

12. The trampoline kit according to claim 1, wherein each of the structural connection joints includes a net support post receiver, and the net support post receiver is configured to retain the respective net support post through one or more of a spring button or a fastener.

13. The trampoline kit according to claim 1, wherein each of the net support posts comprises an angular bend, allowing horizontal displacement of a vertical portion of the respective net support post in an outward direction from the protective net when each respective net support post is installed within a respective structural connection joint.

14. The trampoline kit according to claim 1, further comprising a plurality of springs configured to elastically couple the rebounding mat to the support frame.

15. A trampoline, comprising:

a support frame including:

a plurality of tubular loop members;

a plurality of structural connection joints each connected between two adjacent ones of the plurality of tubular loop members; and a plurality of tubular legs each connected to a respective one of the plurality of structural connection joints;

a plurality of net support posts each having:

a terminal end respectively connected to a respective one of the plurality of structural connection joints, and a connection end opposite the terminal end;

a rebounding mat disposed on the support frame; and a protective net having:

an upper edge connected to the connection ends of the plurality of net support posts; and a lower edge sewn onto the rebounding mat.

16. The trampoline according to claim 15, wherein the protective net is attached through a plurality of attached elastic net support bands, elastically engaged within a respective plurality of net support connectors of the plurality of net support posts, wherein the net support connectors are respectively disposed at the connection end of the net support posts opposite the terminal ends, such that the protective net is deployed in a tensioned state wherein each of the net support connectors is provided with a band retention cavity, and each net support band is engaged within a respective band retention cavity.

17. The trampoline according to claim 16, wherein the band retention cavity comprises an L-shaped structure.

18. The trampoline according to claim 16, wherein an awning is mounted above the support frame, a plurality of awning retention bands are connected to the awning, and each awning retention band is engaged with a respective band retention cavity.

19. The trampoline according to claim 15, further comprising a plurality of water spray heads respectively disposed on the net support connectors, the spray heads including articulating spray nozzles for spraying water towards the protective net.

20. The trampoline according to claim 15, further comprising:

a net seam webbing sewn at a lower edge of the protective net and disposed above a periphery of the rebounding mat;

a lower webbing disposed at the periphery of the rebounding mat;

a plurality of mat retention webbings disposed between the periphery of the rebounding mat and the lower webbing, each of the plurality of mat retention webbings folded in half to form a v-ring retention loop; and a plurality of v-rings disposed around the circumference of the rebounding mat, each connected to the v-ring retention loop of corresponding one of the plurality of mat retention webbings, wherein the net seam webbing, the periphery of the rebounding mat, each of the plurality of mat retention webbings, and the lower webbing are sewn together.

* * * * *